US012543843B2

(12) United States Patent
Martin

(10) Patent No.: US 12,543,843 B2
(45) **Date of Patent: *Feb. 10, 2026**

(54) WEARABLE SUNBLOCK HOLDING ACCESSORY

(71) Applicant: David Edward Martin, Quarteira (PT)

(72) Inventor: David Edward Martin, Quarteira (PT)

(73) Assignee: Shoreline Vault LLC, Lewes, DE (US)

( * ) Notice: Subject to any disclaimer, the term of this patent is extended or adjusted under 35 U.S.C. 154(b) by 203 days.

This patent is subject to a terminal disclaimer.

(21) Appl. No.: 18/373,386

(22) Filed: Sep. 27, 2023

(65) Prior Publication Data

US 2026/0007225 A1 Jan. 8, 2026

Related U.S. Application Data

(63) Continuation-in-part of application No. 17/949,050, filed on Sep. 20, 2022, now Pat. No. 11,805,889.

(51) Int. Cl.
*A45D 40/18* (2006.01)
*A45F 5/00* (2006.01)

(52) U.S. Cl.
CPC ..... *A45F 5/00* (2013.01); *A45F 2005/002* (2013.01); *A45F 2005/008* (2013.01)

(58) Field of Classification Search
CPC .... A45D 40/18; A45D 40/22; A45D 40/0012; A45D 33/006; A45D 40/00; A45D 33/08; A45D 33/33; A45F 2005/002; A45F 2005/008; A45F 2003/006; A45F 2003/008; A44C 5/003
USPC ..... 224/165
See application file for complete search history.

(56) References Cited

U.S. PATENT DOCUMENTS

| | | | | |
|---|---|---|---|---|
| 6,464,389 | B1 * | 10/2002 | Ghoorahoo | G04B 37/127 368/278 |
| 8,474,284 | B2 * | 7/2013 | Rush | A63F 11/0002 63/11 |
| 8,506,158 | B2 * | 8/2013 | Keung | A44C 5/0084 368/282 |
| 8,897,100 | B2 * | 11/2014 | Joo | G04F 3/06 368/109 |
| 10,325,479 | B2 | 6/2019 | Fateh et al. | |
| 10,463,133 | B2 | 11/2019 | Sun et al. | |
| 11,812,841 | B2 * | 11/2023 | Lee | A45D 40/222 |
| 2005/0022554 | A1 * | 2/2005 | Davidson | A44C 17/0208 63/1.14 |
| 2008/0251539 | A1 | 10/2008 | Yapaola et al. | |
| 2014/0117060 | A1 * | 5/2014 | Colone | A44C 5/003 224/219 |
| 2014/0261530 | A1 * | 9/2014 | Mcnamara | A45D 40/00 132/286 |
| 2018/0368541 | A1 * | 12/2018 | Burr | A44C 25/002 |

* cited by examiner

*Primary Examiner* — Adam J Waggenspack
(74) *Attorney, Agent, or Firm* — Plager Schack LLP; Mark H. Plager; Naomi Mann

(57) ABSTRACT

Disclosed is a UV protection system comprising providing a wearable sunblock holding accessory, the wearable sunblock holding accessory comprising a wearable main body including a strap and a receptacle coupled to the strap, wherein the receptacle is configured to hold a removable sunblock container unit.

11 Claims, 8 Drawing Sheets

WEARABLE SUNBLOCK HOLDING ACCESSORY

RELATED APPLICATION

This application is a continuation-in-part and claims benefit to U.S. application Ser. No. 17/949,050 filed on Sep. 20, 2022, which is incorporated by reference herein in its entirety.

BACKGROUND

The present disclosure relates generally to UV protection systems and more particularly to devices for containing sunblock/sunscreen.

Individuals may sometimes forget to apply sunscreen, and/or not have sunscreen readily available when needed. As such, there is a need for an improved system that addresses these problems.

SUMMARY

According to various embodiments, disclosed is a wearable sunblock holding accessory, and a UV protection system. In some embodiments, the accessory may comprise a sunblock holder including an interior cavity configured to contain sunblock; and a strap configured to attach the sunblock holder to a user's body. In some embodiments, the accessory may comprise a wearable main body including a strap and a receptacle coupled to the strap, wherein the receptacle is configured to hold a removable sunblock container unit. In certain embodiments, the wearable sunblock holding accessory is in the form of a wristwatch.

In certain embodiments, the UV protection system may comprise providing a wearable sunblock holding accessory, the wearable sunblock holding accessory comprising a wearable main body including a strap and a receptacle coupled to the strap, wherein the receptacle is configured to hold a removable sunblock container unit, wherein the removable sunblock container unit includes an interior cavity configured to hold a sun protective composition, and a cover configured to open and close over the interior cavity, wherein the strap is configured to attach the wearable sunblock holding accessory around a limb of a user's body; applying sun protective composition contained within the removable sunblock container unit to the user's body, while wearing the wearable sunblock holding accessory around the user's limb.

In certain embodiments, the wearable sunblock holding accessory is in the form of a wristwatch, wherein the receptacle resembles a wristwatch timepiece when the removable sunblock container unit is held within the receptacle, and wherein the strap includes a first strap end coupled to a first side of the receptacle and a second strap end coupled to a second side of the receptacle. In some embodiments, the strap comprises two strap halves configured to buckle together. In certain embodiments, the strap comprises a single stretchable band. In some embodiments, the cover of the removable sunblock container unit is rotationally coupled to a rim of a main container body of the sunblock container unit. In certain embodiments, the rim is removable from the main container body. In certain embodiments, an interior side of the cover of the removable sunblock container unit includes a mirror. In certain embodiments, the UV protection system further comprises providing a UV sensitive element on at least one of the wearable sunblock holding accessories, and the removable sunblock container unit. In certain embodiments, the UV sensitive element is selected from at least one of a material forming the wearable sunblock holding accessory, a material forming the removable sunblock container unit, a paint, a sticker, and a trinket object attachable to the wearable sunblock holding accessory. In some embodiments, the sunblock is in solid form. In some embodiments, the sunblock is in semi-solid form. In certain embodiments, the UV protection system further comprises replacing a used removable sunblock container unit with a new removable sunblock container unit. In certain embodiments, the wearable sunblock holding accessory is made of a silicone and/or silicone rubber.

BRIEF DESCRIPTION OF THE FIGURES

The detailed description of some embodiments of the invention will be made below with reference to the accompanying figures, wherein the figures disclose one or more embodiments of the present invention.

FIG. 6 is a perspective view of the wearable sunblock holding accessory, wherein the sunblock container unit is shown installed within the main body and in an open position.

FIG. 7 shows the wearable sunblock holding accessory of FIG. 6, with the sunblock container unit in a closed position.

FIG. 8 is an exploded view of the wearable sunblock holding accessory, with the sunblock container unit shown disassembled from the main body.

FIG. 9 is an exploded view of the sunblock container unit.

FIG. 10 is a perspective view of the wearable main body.

FIG. 11 is a side view of the wearable main body.

FIG. 12 is a section view taken along line A-A of FIG. 11.

DETAILED DESCRIPTION OF CERTAIN EMBODIMENTS

Figure 1:
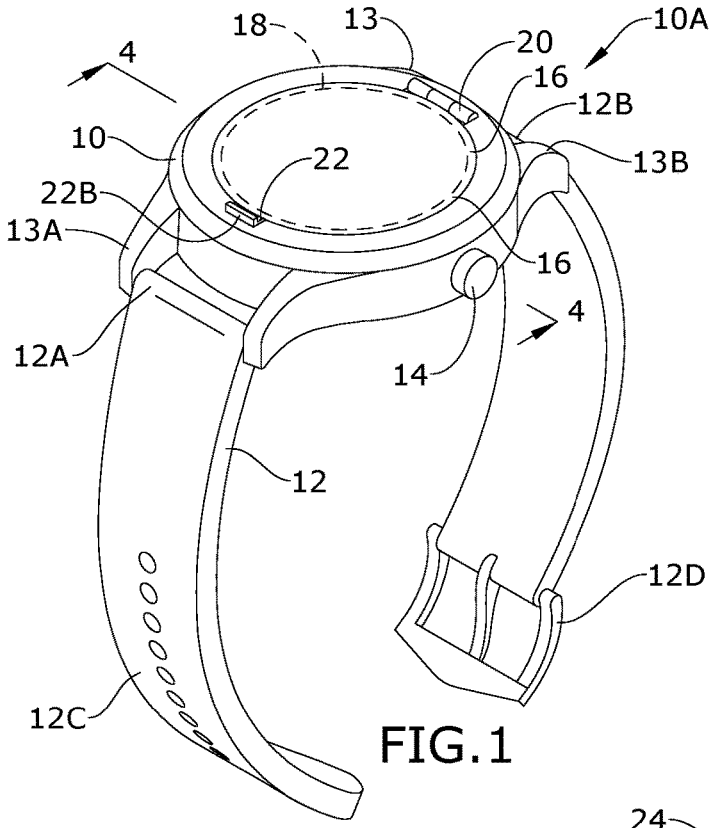
FIG. 1 is a perspective view of a wearable sunblock holding accessory having the form of a wristwatch, in accordance with various embodiments.
Figure 2:
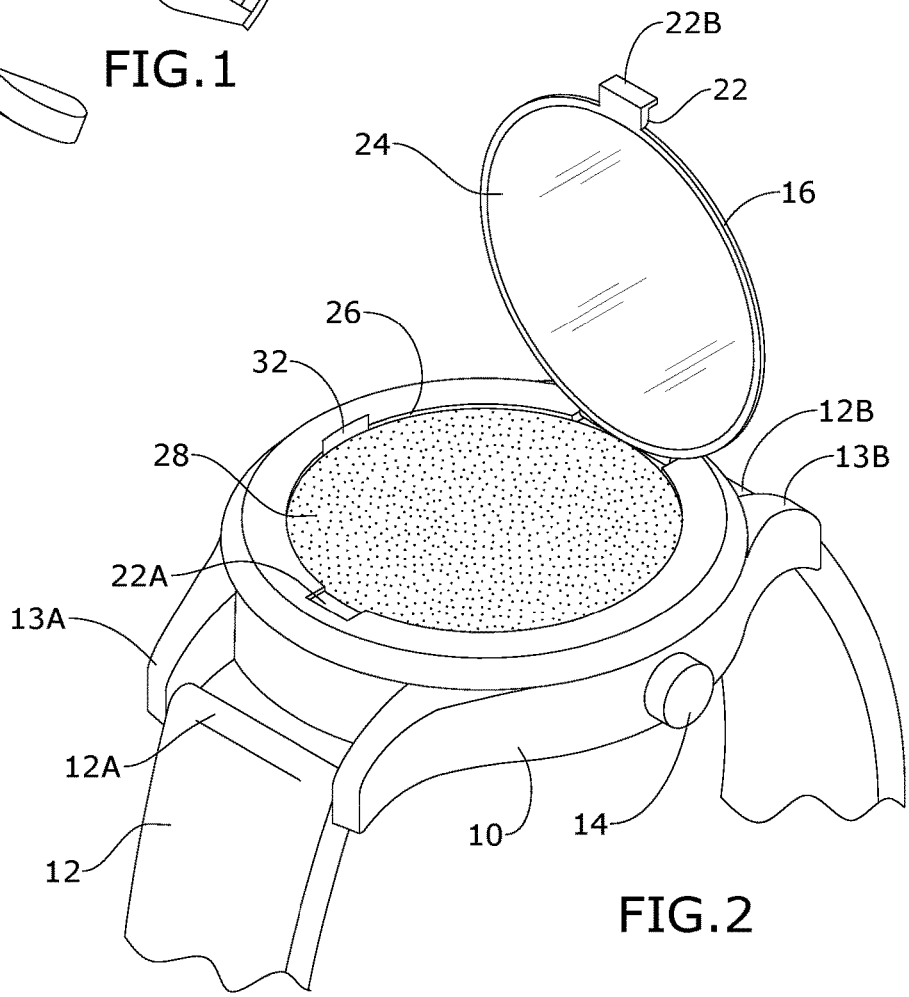
FIG. 2 is a perspective view of the wearable sunblock holding accessory, showing a cover of accessory in an open position.
Figure 3:
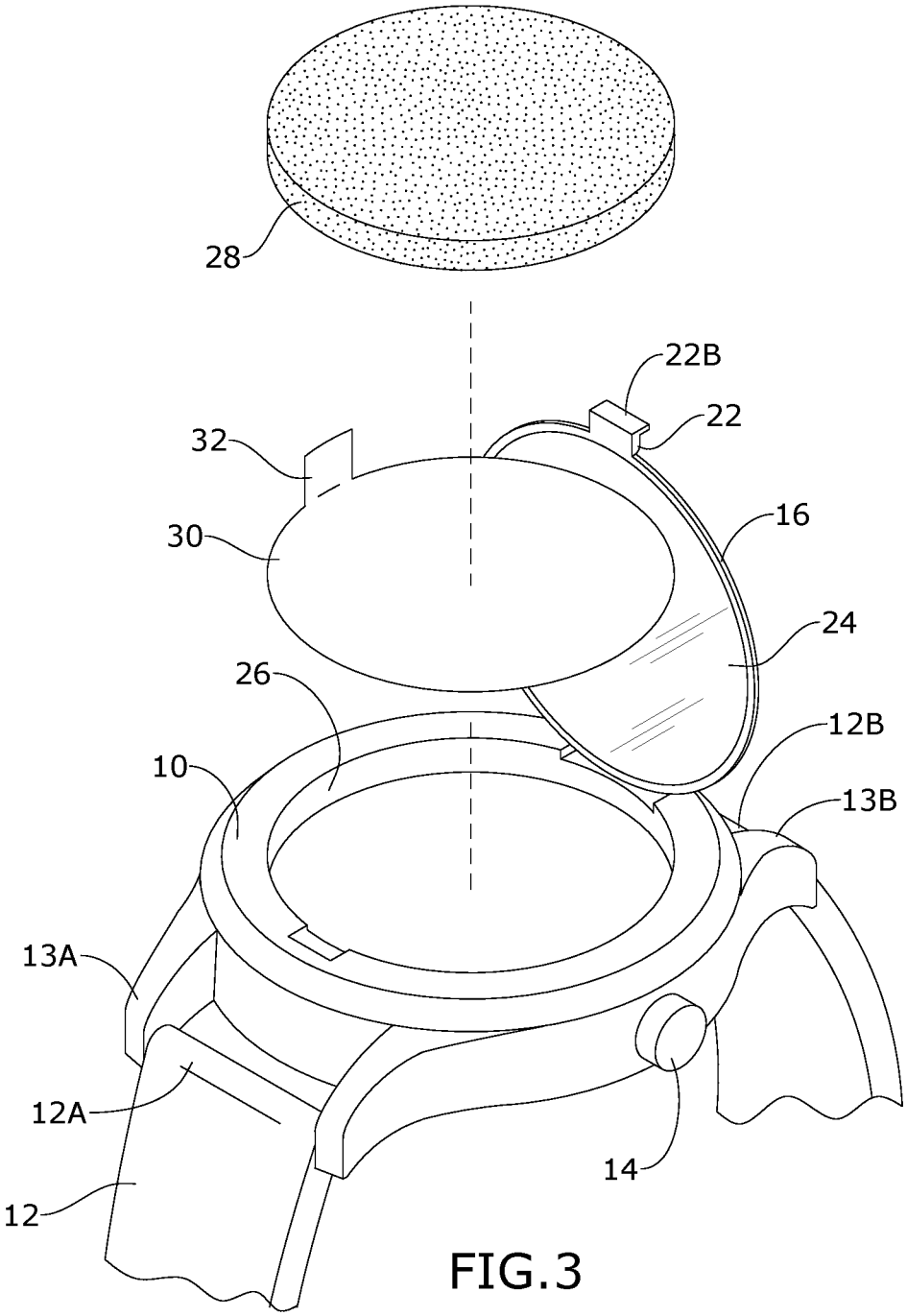
FIG. 3 is an exploded view of the wearable sunblock holding accessory.
Figure 4:
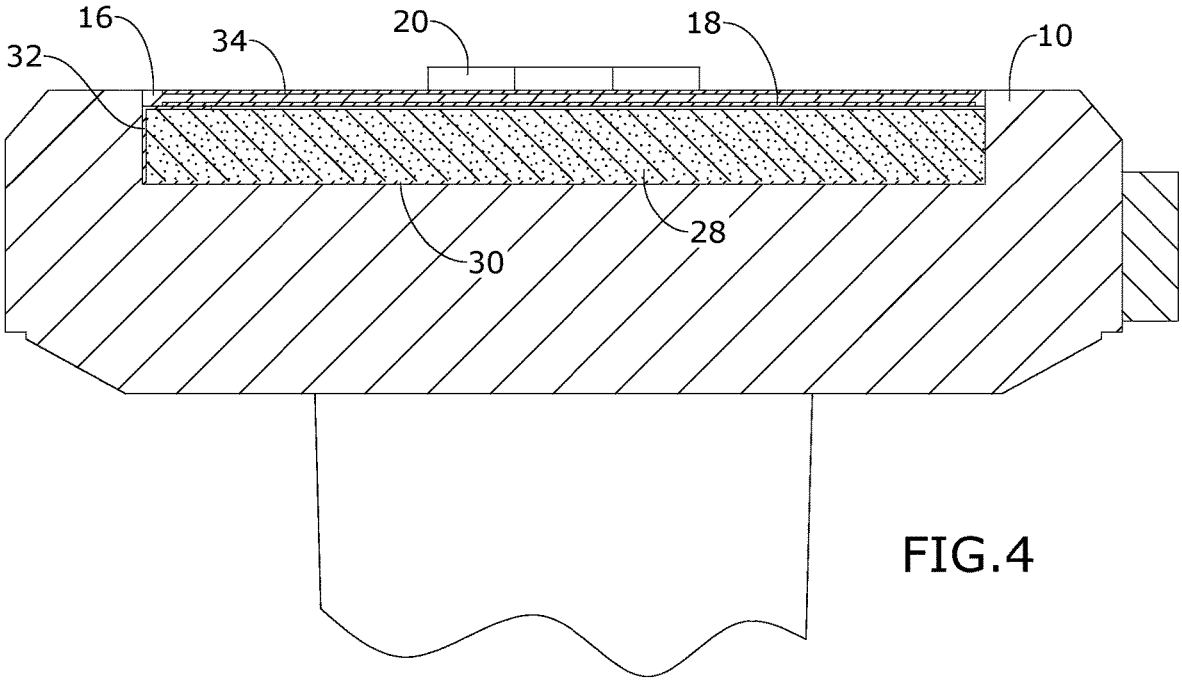
FIG. 4 is a section view of the wearable sunblock holding accessory, taken along line 4-4 in FIG. 1
Figure 5:
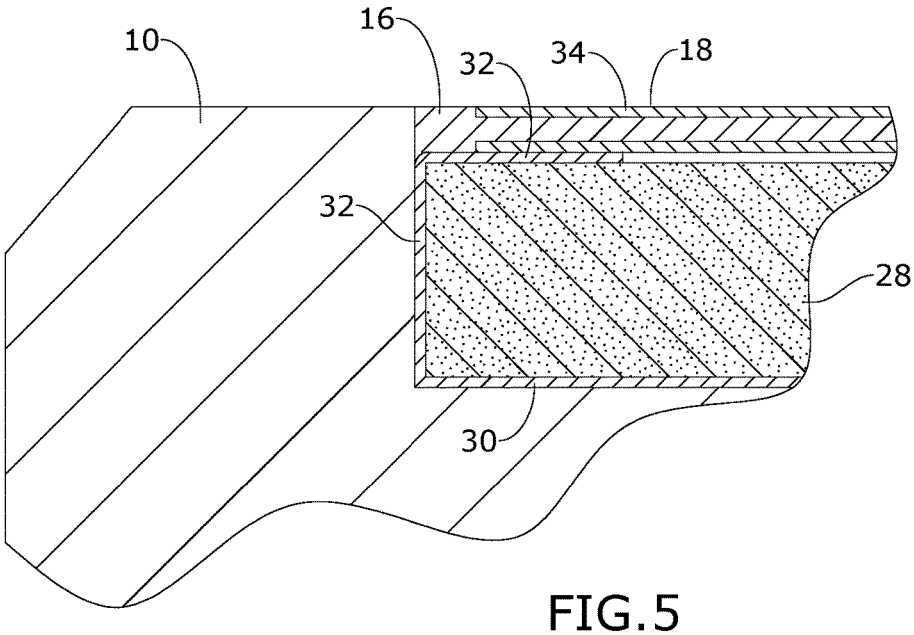
FIG. 5 is a detailed section view of the wearable sunblock holding accessory.
Figure 6:
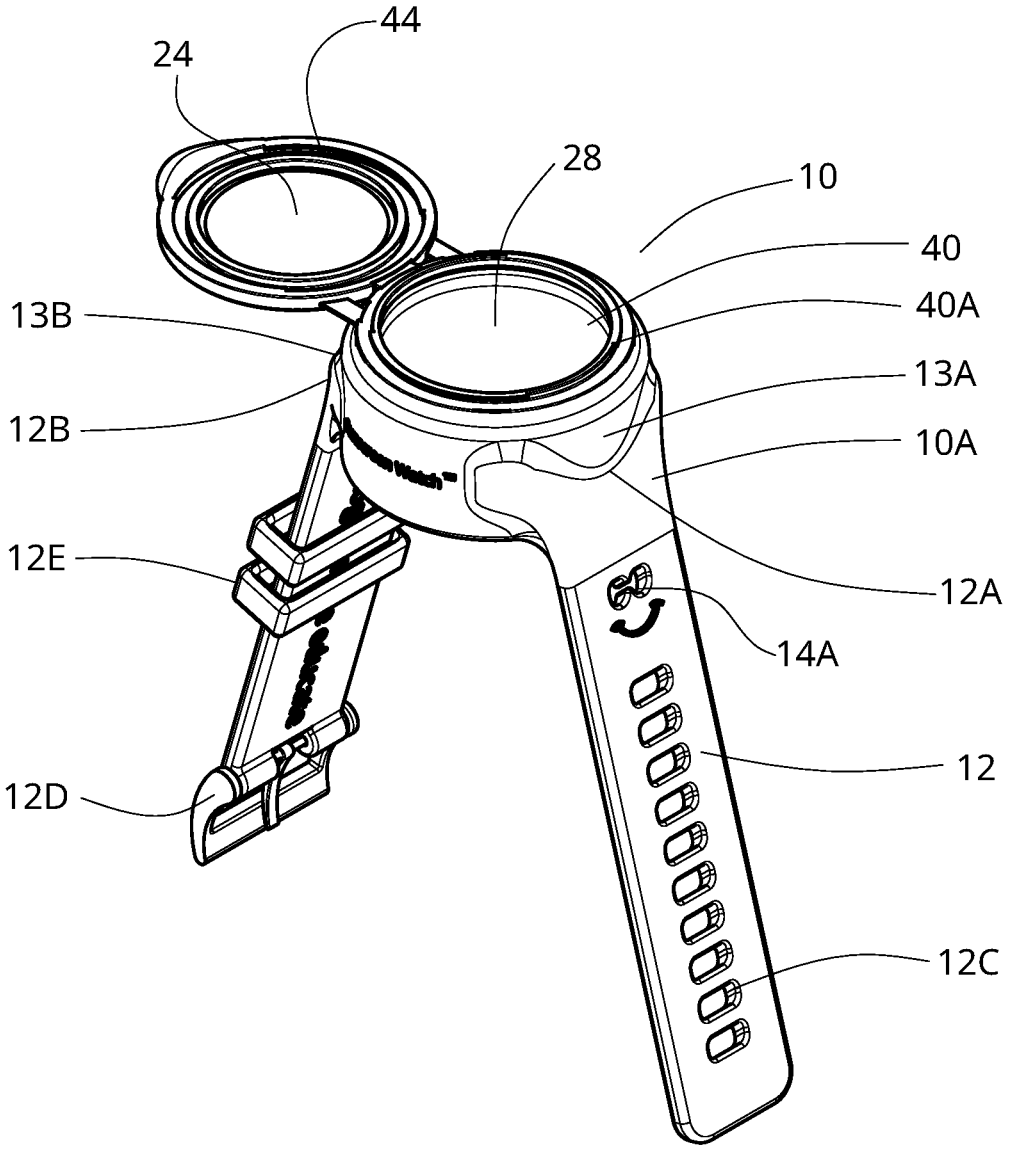
FIGS. 6-12 show a wearable sunblock holding accessory which includes a sunblock container unit which is removable from a wearable main body of the accessory, according to an alternate embodiment.

According to various embodiments as depicted in FIGS. 1-12, disclosed is a UV protection system comprising a wearable sunblock holding accessory 10 configured to hold a sun protective composition 28 such as sunblock, sunscreen, and the like (referred to herein as "sunblock 28"). In certain embodiments, sunblock 28 may be a solid or semi-solid sunblock. In some embodiments, the disclosed system may provide for refills of sunblock 28. In other embodiments, wearable sunblock holding accessory 10 may be provided as a disposable, single use product. In some embodiments, wearable sunblock holder accessory 10 may comprise a UV sensitive element configured to detect and indicate a level of UV radiation.

In some embodiments as depicted in FIGS. 1-5, wearable sunblock holding accessory 10 may comprise an integrated sunblock holder 13 containing sunblock 28, within a wearable main body 10A. In other embodiments as depicted in FIGS. 6-12, wearable sunblock holding accessory 10 may include a removable sunblock container unit 40 containing sunblock 28 and configured to install into a receptacle 40A within wearable main body 10A.

In certain embodiments, wearable sunblock holding accessory 10/wearable main body 10A may have the form and appearance of a wristwatch and is configured to be worn around a user's wrist. To this end, wearable sunblock holding accessory 10 may comprise a wrist strap 12 coupled to sunblock container 13 or receptacle 40A.

Figure 7:
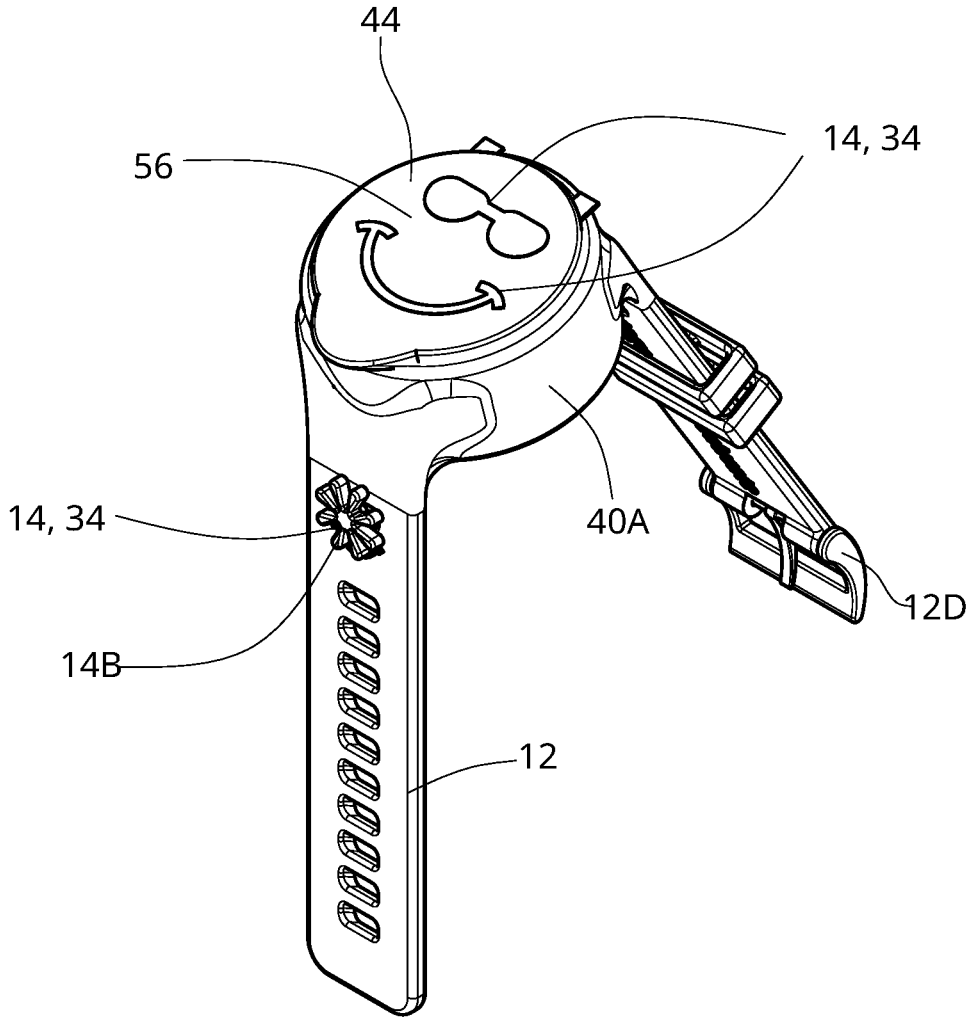
Figure 8:
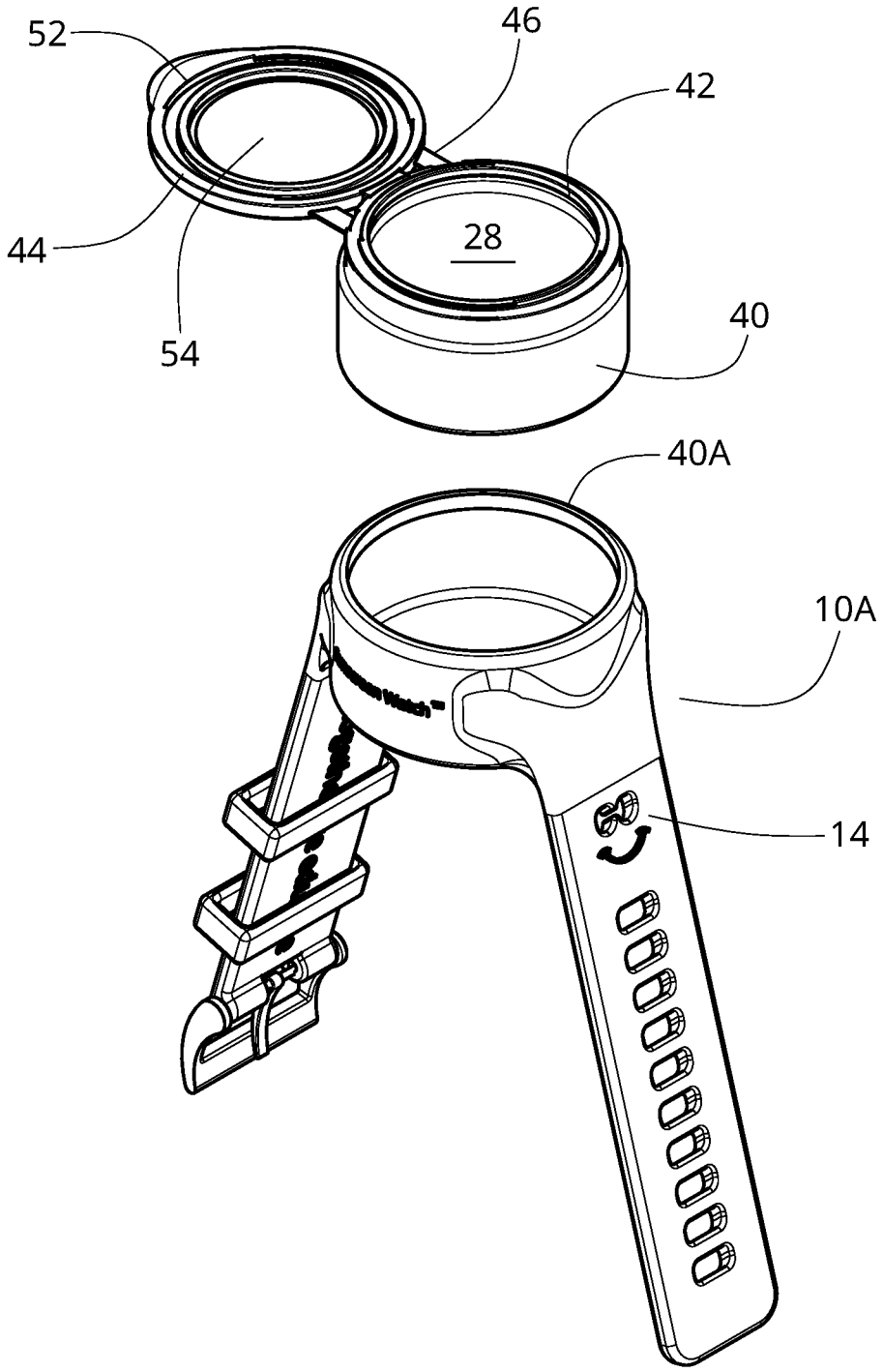
Figure 9:
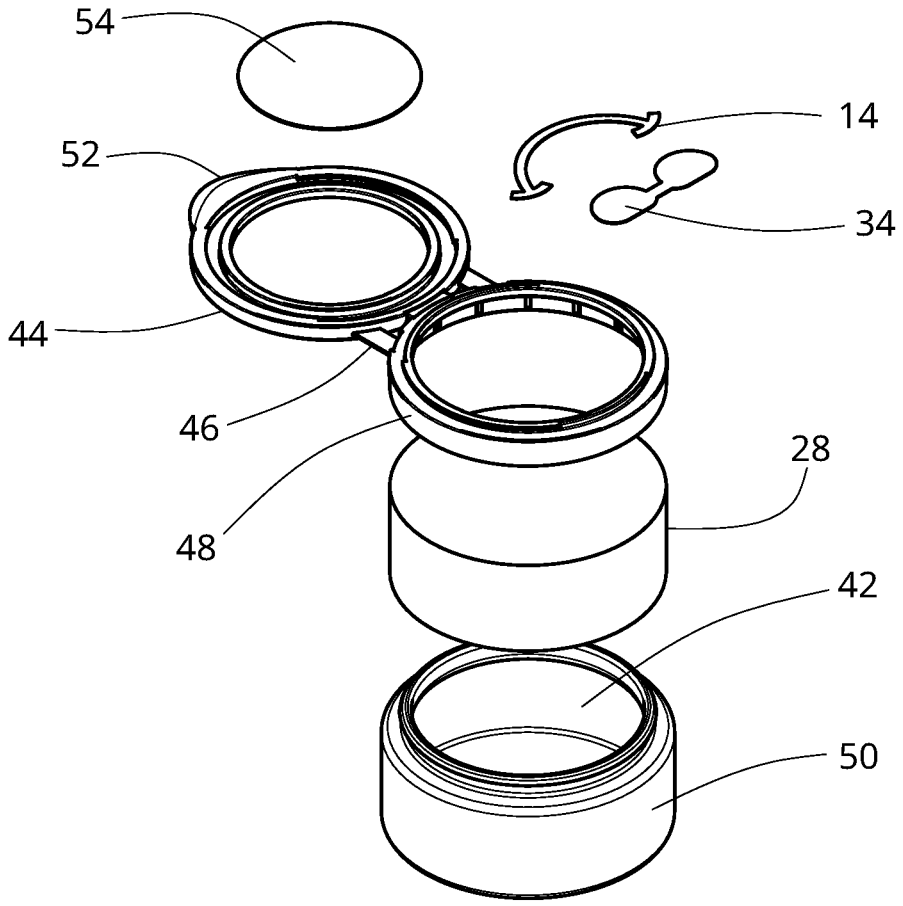
Figure 10:
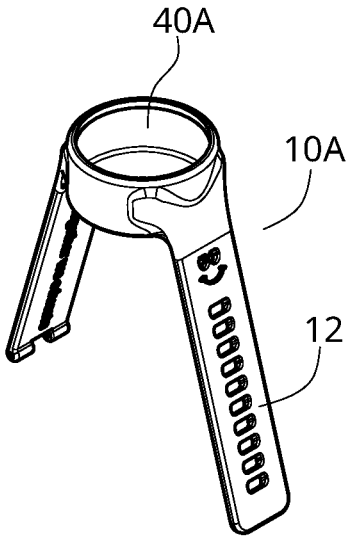
Figure 12:
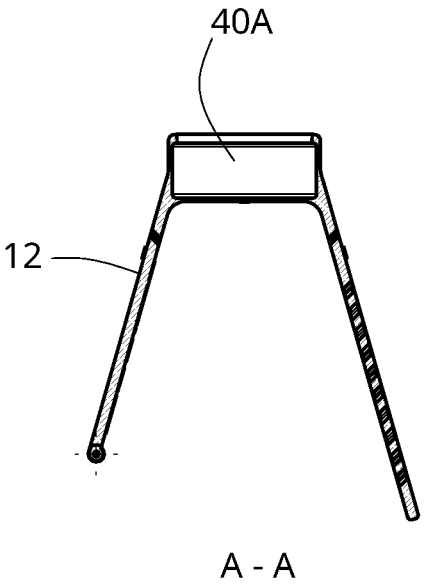
Figure 11:
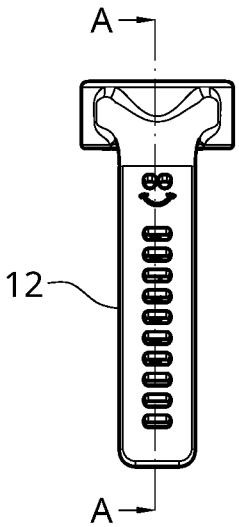

In further embodiments, sunblock holding accessory 10, sunblock container 13, and/or sunblock container unit 40 may further comprise various decorative elements 14 such as a button resembling a watch crown, fanciful art, and the like. Such decorative elements 14 may also serve a functional purpose as will be described and/or make sunblock holding accessory 10 more engaging for a child. In some embodiments, strap 12 may include indentations or holes 14A to which trinket objects 14B may be affixed. In some embodiments, such indentations or holes 14A may also serve as decorative elements 14. For example, a smiley face decoration, as shown in the figures, may incorporate holes 14A for the eyes of the smiley face, and may further be configured to hold a flower trinket object 14B, as shown in FIG. 7, and the like.

In certain embodiments, wrist strap 12 may comprise first strap end 12A and a second strap end 12B coupled to sunblock container 13 at opposite sides 13A and 13B of sunblock container 13 or receptacle 40A, respectively. In one embodiment as depicted in FIG. 1, wrist strap 12 may be an adjustable buckle strap, comprising a first strap half with notches 12C and a second strap half with a buckle 12D. In further embodiments, first and second strap ends 12A, 12B, may be coupled to sunblock container 13/receptacle 40A via lugs or other connection elements provided at sides 13A and 13B of sunblock container 13 or receptacle 40A. However, in other embodiments, these components may be an integral unit. It shall be appreciated that different strap designs including attachment configurations may be employed in alternate embodiments. For example, a single piece strap which may be a stretchable band (e.g., silicone rubber) may be used instead of a two-piece strap in some embodiments. Additionally, while sunblock container 13, receptacle 40A, and container unit 40 are depicted as circular, different geometric configurations (e.g., square, rectangular, etc.) may be provided in alternate embodiments.

In certain embodiments as best depicted in FIGS. 1-5, sunblock container 13 may comprise an interior cavity 26 configured to hold solid or semi-solid sunblock 28. In further embodiments, sunblock container 13 may comprise a cover 16 configured to open and close interior cavity 26. In one embodiment, cover 16 may be rotationally coupled to interior cavity 26 via a hinge 20 attached between the rims of the cavity and cover. In further embodiments, cover 16 may be configured to securely close over interior cavity 26 via a locking mechanism. In some embodiments, the locking mechanism may comprise a latch 22 comprising a latch release component 22B provided on the rim of cover 16. Latch 22 may be configured to engage within a recess 22A provided within the rim of interior cavity 26, and to disengage by pushing against latch release component 22B with the user's finger. In some embodiments, latch 22 and recess 22A may include magnetic components for a magnetic attachment in the closed position. It shall be appreciated that various lock and release mechanisms may be provided in alternate embodiments. For example, decorative element 14 configured as a button resembling the watch crown may also function as a release button which causes cover to open upon pressing the button in alternate embodiments. In certain embodiments, a mirror 24 may be provided on an interior surface of cover 16. Mirror 24 may be, for example, a glass mirror, or a non-glass mirror such as a stick-on mirror, according to alternate embodiments. As such, cover 16 protectively preserves sunblock 28 within interior cavity 26, and may be opened to expose sunblock 28 and mirror 24 such that a user may view him/herself when applying sunblock 28.

In certain embodiments as best depicted in FIGS. 6-12, removable sunblock container unit 40 is configured to install into receptacle 40A and may be easily replaced with a new container unit when the sunblock is used up. In one embodiment, receptacle 40A may be made of a high friction rubber, a silicone and/or a rubber silicone material. In another embodiment, sunblock container unit 40 may be configured to screw into receptacle 40A. It shall be appreciated however, that multiple and/or alternate mechanisms for a releasable but secure attachment of container unit 40 within receptacle 40A may be used in alternate embodiments. In some embodiments, sunblock container unit 40 may comprise an interior cavity 42 configured to hold sunblock 28. In further embodiments, sunblock container unit 40 may comprise a cover 44 configured to open and close over interior cavity 42. In some embodiments, cover 44 may be rotationally coupled to interior cavity 42 via a hinge 46 coupled between the rims of the cavity and cover. In one embodiment, sunblock container unit 40 may include a removable rim 48 supporting hinge 46 and cover 44. In one embodiment, removable rim 48 may be attachable to a main container body 50 of sunblock container unit via a threaded engagement, or via a friction/snap fit engagement, and the like. Removable rim 48 may further be configured to non-permanently secure to a rim of receptacle 40A. Cover 44 may be configured to securely close over interior cavity 42 and/or over rim 48. In one embodiment, a releasable locking mechanism, such as a latch engagement mechanism, may be provided to secure cover 44 to interior cavity and/or rim 48. In other embodiments a releasable snap lock mechanism may be provided, with a tab release component 52 which may effectuate disengagement when pushed upwards (e.g., with the thumb). It shall be appreciated that multiple and/or alternate lock and release mechanisms may be provided in different embodiments, such as magnetic attachment components, threaded engagement between the cover and rim (omitting hinge 46), and the like. In certain embodiments, a mirror 54 may be provided on an interior surface of cover 44. Mirror 54 may be, for example, a glass mirror, or a non-glass mirror such as a stick-on mirror, according to alternate embodiments. As such, cover 44 protectively preserves sunblock 28 within interior cavity 42, and may be opened to expose sunblock 28 and mirror 54 such that a user may view him/herself when applying sunblock 28. In some embodiments, UV sensitive element 34 may be placed on an exterior surface 56 of cover 44 opposite mirror 54. In one embodiment, UV sensitive element 34 may also function as decorative element 14.

In certain embodiments, sunblock 28 may be provided in a solid cake form or semi-solid form, which prevents spilling as opposed to a liquid sunblock. In certain embodiments as best depicted in FIGS. 1-5, a liner 30, which may be a paper sheet, may be disposed beneath sunblock 28. Liner 30 may include a tab 32 which sticks out from sunblock 28, such that a user may pull up tab 32 to remove and replace sunblock 28 with a new refill. It shall be appreciated that liquid or any other form of sunblock may be used in alternate embodiments. In certain embodiments, wearable sunblock holder accessory 10 may be provided as a disposable single use sunblock container which may be thrown away after the sunblock has been used up.

In certain embodiments, UV sensitive element 34 may be provided on the outer surface of accessory 10 for indicating UV levels which may warrant the application of sunscreen. UV sensitive element 34 may comprise for example, a UV sensitive plastic, paint, or other material which changes color in the sun or otherwise provides an indication of the UV level. In some embodiments, decorative elements 14 may also function as UV sensitive element 34. In certain embodiments, as shown in FIGS. 6-12, various decorative stickers which are UV sensitive, or UV sensitive paint may be used to create images that make accessory 10 playful and educational for a child. Some non-limiting examples may include images of a color changing chameleon, parrot, flower, sunglasses with a smiley face (shown in the figures), emojis, etc. In some embodiments, attachable trinket object(s) 14B may also be made of a UV sensitive material. It shall be appreciated that various parts of wearable sunblock holder accessory 10 may be decorated with and/or made of various types of UV sensitive material. In one embodiment, UV sensitive element 34 may be provided on a front side 18 of cover 16 opposite mirror 24. In another embodiment, strap 12 may be made of UV sensitive plastic. In a further embodiment, strap 12 may be provided with strap holder loops 12E made of a UV sensitive material.

Thus, the disclosed subject matter provides a system which enables an individual to conveniently carry sunblock and may further encourage and/or remind the user to apply sunblock. The device may be used by individuals of any age but may be a particle useful tool for educating and encouraging young children to apply sunblock.

It shall be appreciated that the disclosed wearable sunblock holder accessory 10 can have multiple configurations and/or additional components in different embodiments. For example, the disclosed accessory may also incorporate a time display screen, timer, alarm, and various other electronic components. In some embodiments, accessory 10 may be configured to sound an alarm when UV radiation is particularly high. In some alternate embodiments, wearable sunblock holder accessory 10 may be in the form of a bracelet, anklet, pendant/necklace, armband, belt, or various other accessories worn on the body. It shall be appreciated that the components of wearable sunblock holder accessory 10 may comprise any alternative known materials in the field and be of any size and/or dimensions. In one embodiment, wearable sunblock holder accessory 10 may comprise a silicone and/or silicone rubber wearable main body 10A, and a plastic removable sunblock container unit 40 with a stick-on mirror for a low cost item. It shall be appreciated that the components of wearable sunblock holder accessory 10 may be manufactured and assembled using any known techniques in the field.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A UV protection method, comprising:

wearing around a wrist of a user a wearable sunblock holding accessory, the wearable sunblock holding accessory comprising a wearable main body including a strap and a receptacle coupled to the strap, and being in the form of a wristwatch, wherein the receptacle contains a removable sunblock container unit having an interior cavity that includes a sun protective composition comprising sunscreen or sunblock contained therein, and a cover configured to open and close over the interior cavity, wherein the wearable sunblock holding accessory is attached around the wrist of the user via the strap, and wherein a UV sensitive element is provided on at least one of the wearable sunblock holding accessory, and/or the removable sunblock container unit.

2. The UV protection method of claim 1, wherein the strap comprises two strap halves configured to fasten together.

3. The UV protection method of claim 1, wherein the strap comprises a single stretchable band.

4. The UV protection method of claim 1, wherein the cover of the removable sunblock container unit is rotationally coupled to a rim of a main container body of the sunblock container unit.

5. The UV protection method of claim 4, wherein the rim is removable from the main container body.

6. The UV protection method of claim 1, wherein an interior side of the cover of the removable sunblock container unit includes a mirror.

7. The UV protection method of claim 1, wherein the UV sensitive element is selected from at least one of a material forming the wearable sunblock holding accessory, a material forming the removable sunblock container unit, a paint, a sticker, and a trinket object attachable to the wearable sunblock holding accessory.

8. The UV protection method of claim 1, wherein the sun protective composition is in solid form.

9. The UV protection method of claim 1, wherein the sun protective composition is in semi-solid form.

10. The UV protection method of claim 1, further comprising replacing a used removable sunblock container unit with a new removable sunblock container unit.

11. The UV protection method of claim 1, wherein the wearable sunblock holding accessory is made of a silicone and/or silicone rubber.

* * * * *